United States Patent [19]

Tsukuda

[11] 4,349,986

[45] Sep. 21, 1982

[54] RADIO-CONTROLLED TOYS

[75] Inventor: Mitsuo Tsukuda, Tokyo, Japan

[73] Assignee: Tsukuda Co., Ltd., Japan

[21] Appl. No.: 969,679

[22] Filed: Dec. 15, 1978

[51] Int. Cl.[3] ..... A63H 30/04; A63H 17/36; H04Q 7/02; G08B 5/22

[52] U.S. Cl. ..... 46/254; 46/262; 340/825.69; 318/16

[58] Field of Search ..... 46/254, 262, 251, 252, 46/253, 255, 256, 257, 258, 259, 260, 261, 263, 248; 340/695, 694; 318/65, 16, 681, 293

[56] References Cited

U.S. PATENT DOCUMENTS

| | | | |
|---|---|---|---|
| 3,052,651 | 12/1974 | Dufendach | 318/681 |
| 3,290,573 | 12/1966 | Kamens | 318/681 |
| 3,408,548 | 10/1968 | Coia | 318/681 |
| 3,504,258 | 3/1970 | Stern et al. | 318/293 |
| 3,548,271 | 12/1970 | Kampfer | 318/16 |
| 3,782,031 | 1/1974 | Byron | 46/254 |
| 3,890,550 | 6/1975 | Izumi et al. | 318/681 |
| 4,080,602 | 3/1978 | Hattori et al. | 46/254 |
| 4,124,811 | 11/1978 | Anderson | 318/293 |
| 4,207,502 | 6/1980 | Omura | 46/254 |

FOREIGN PATENT DOCUMENTS

| | | | |
|---|---|---|---|
| 1965028 | of 1971 | Fed. Rep. of Germany | 46/262 |
| 1498775 | 1/1978 | United Kingdom | 46/262 |

*Primary Examiner*—Gene Mancene
*Assistant Examiner*—Michael J. Foycik
*Attorney, Agent, or Firm*—Cantor and Singer

[57] ABSTRACT

A radio-controlled toy has a transmitter designed to transmit a signal amplified and modulated with a low-frequency square signal by the supply of power effected by closing a switch and a receiver having a receiving circuit portion and a forward-to-reverse switching control. The transmitter may include an astable multivibrator for producing a low-frequency square signal and a crystal oscillation circuit. The forward-to-reverse switching control is designed such that when no signal is received, a d.c. motor turns forward and when a signal is received, the d.c. motor turns in reverse.

1 Claim, 14 Drawing Figures

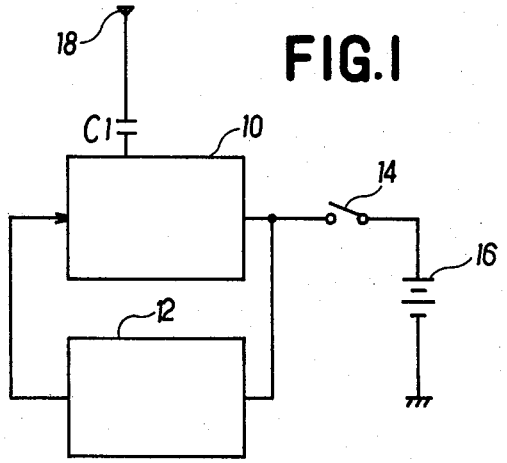
FIG.1
FIG.2
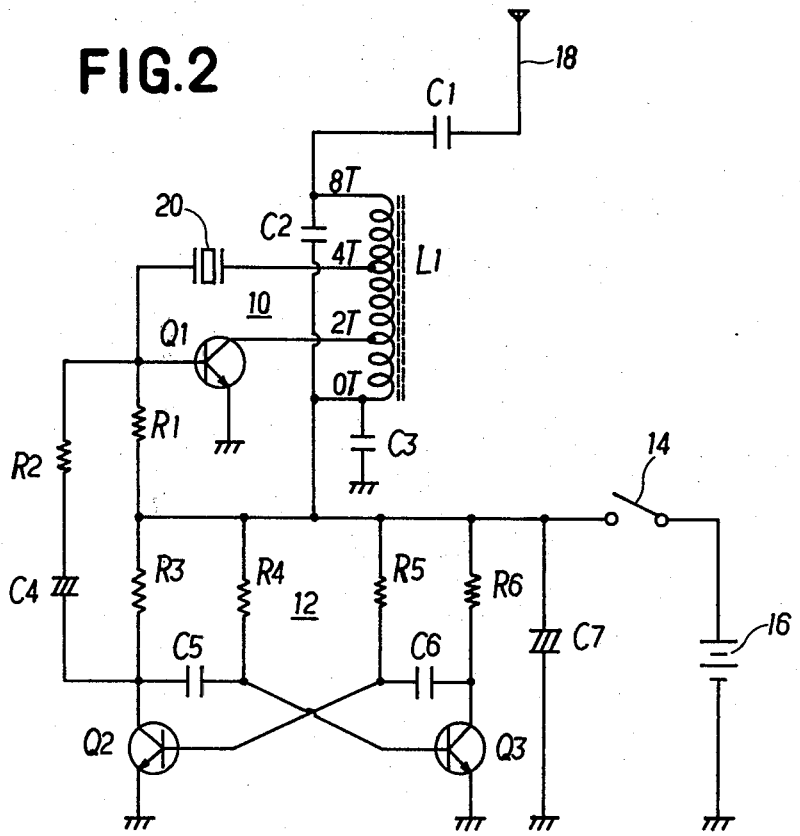

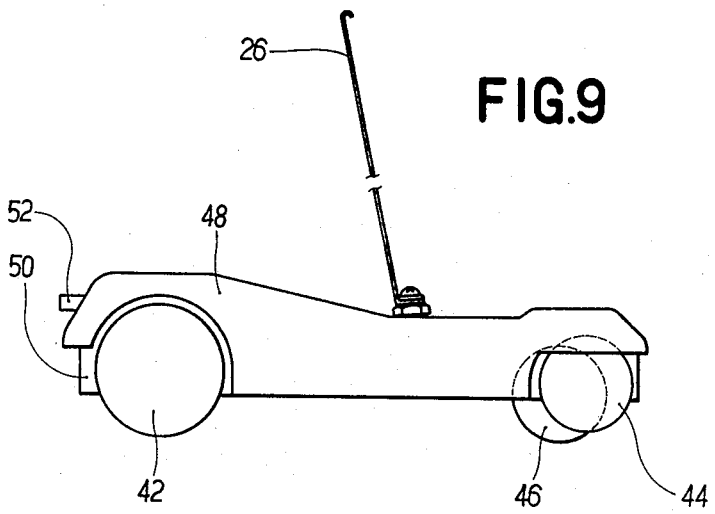
FIG.9
FIG.10
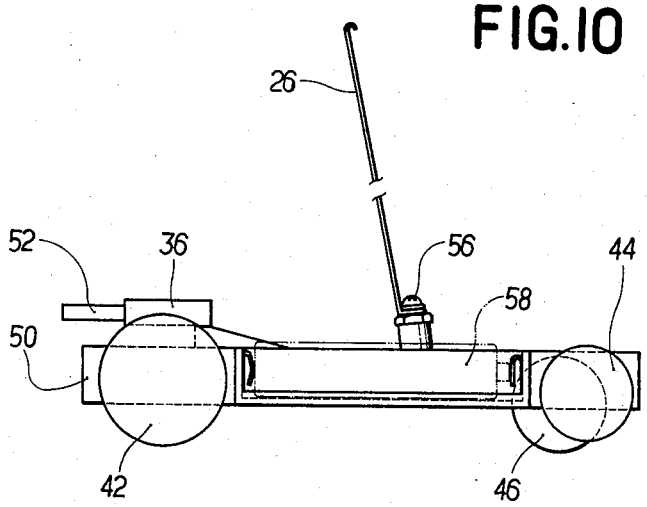

RADIO-CONTROLLED TOYS

BACKGROUND OF THE INVENTION

1. Field of the Invention

The present invention relates to a radio-controlled by and more particularly to a radio-controlled toy which can be handled in a confined place, e.g., in a room by simple control and a relatively small power supply.

2. Description of the Prior Art

In recent years radio-controlled toy cars and so on have been complexed more and more. As a consequence, the direction control mechanism, speed control mechanism etc. are improved to the same degree as in the actual automobiles. This inevitably results in an increase in the number of control signals and in the complexity of the transmitter and receiver used. In addition, there is an increasing demand for a radio-controlled toy car which can be used over a wider range. For these reasons, the power source used should be of larger capacity. However, such complicate radio-controlled toys are now used for adult pastimes, rather than as child's toys. Therefore, the existing radio-controlled toys are not suitable for infant's toys, since they are too difficult for an infant to handle indoors due to their complexity and rapid movement, and is also expensive. Further, such toys may cause jamming to a radio, television or the like in a room due to the increased output of the transmitter used.

SUMMARY OF THE INVENTION

Accordingly, it is a particular object of the present invention to provide an inexpensive and tough radio-controlled toy which is very simple to handle because of the use of small d.c. power supply and less transmission power and, therefore, causes no jamming to other equipment.

It is an additional object of the present invention to provide a radio-controlled toy which can be operated at 3 volts d.c. induced from two dry cells.

It is an additional object of the present invention to provide a transmitter designed to transmit a sending wave amplified and modulated by a low-frequency square signal by the supply of power effected by closing a switch for the purpose of saving power consumption.

It is an additional object of the present invention to provide a receiver designed to adopt a regenerative reception system so as to obtain high reception sensitivity.

It is an additional object of the present invention to provide a receiver equipped with a forward-to-reverse switching control designed such that ony when a signal is received, a d.c. motor turns in reverse and when no signal is received, the d.c. motor turns forward.

It is an additional object of the present invention to provide a radio-controlled toy in which circuit devices are miniaturized by integration of a receiver and a transmitter.

It is another object of the present invention to provide a radio-controlled toy comprising a car body driven by a d.c. motor and equipped with a receiver, which body is remote-controlled by operation of a transmitter.

It is still another object of the present invention to provide a radio-controlled toy having a front wheel provided with a steering mechanism for rotating a car body in one direction during its backward movement.

BRIEF DESCRIPTION OF THE ACCOMPANYING DRAWINGS

The present invention may best be understood by reference to the following description, taken in connection with the accompanying drawings in which:

FIG. 1 shows a circuit block diagram of the transmitter according to the present invention, FIG. 2 is a circuit diagram illustrative of one embodiment of the circuit construction of the transmitter according to the present invention, FIG. 3 is a circuit diagram showing the integrated circuit portion in the transmitter of FIG. 2, FIG. 4 is a perspective view showing the transmitter according to the present invention, FIG. 5 is a perspective view showing the transmitter from which an upper lid has been removed, FIG. 6 is a circuit block diagram of the receiver according to the present invention, FIG. 7 is a circuit diagram showing one embodiment of the receiver circuit according to the present invention, FIG. 8 is a circuit diagram showing the integrated circuit portion in the receiver of FIG. 7, FIG. 9 is a side view of the toy car having thereon the receiver of FIG. 7, FIG. 10 is a side view of the toy car from which a cover has been removed, FIG. 11 is a side view showing the driving mechanism for the toy car, FIG. 12 is a bottom view showing the front wheel.

FIG. 13 is a plan view showing the steering mechanism for the front wheel, and FIG. 14 is a plan viewshowing the steering mechanism for the front wheel which is put in a state where it is subjected to backward movement and rotation.

DETAILED DESCRIPTION OF THE INVENTION

Figure 3:
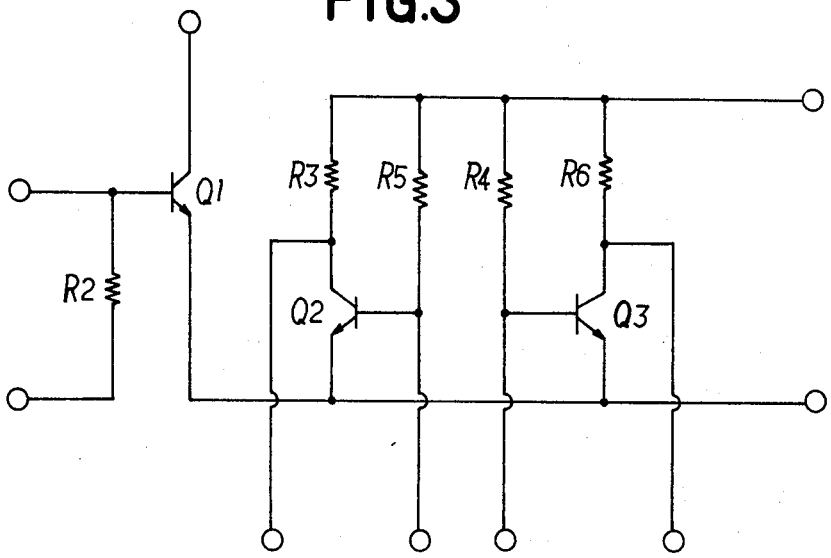

Referring now to FIG. 1, there is shown a circuit block diagram illustrative of the transmitter according to the present invention, which comprises a crystal oscillation circuit 10 and an astable multivibrator 12. A d.c. power source 16 is fed through a transmitter switch 14, and the output of the crystal oscillation circuit 10 is sent out of a transmitter antenna 18. The d.c. source 16 is comprised of two dry cells of MU-4 or AAA size, and a supply voltage is 3.0 volts.

FIG. 2 is indicative of the concrete circuit construction of the transmitter shown in FIG. 1, which comprises a transistor Q1, a crystal oscillator 20 and a coil L1. The crystal oscillator 20 is designed for use in a resonance frequency of 27.125 MHz, while coil L1 is constructed from a 8 mm $\phi$ core having 8 turns of a 0.25 mm$\phi$ enameled copper wire with its reactance being 1.55 $\mu$H and Q=0.17 (1 KHz). Coil L1 is connected with the antenna 18 through a capacitor C1 connected in series with a capacitor C2 connected in parallel therewith to drive the antenna 18 by the oscillation output of the crystal oscillator circuit 10. According to this embodiment, on the other hand, the astable multivibrator 12 comprising transistors Q2 and Q3 has an oscillation frequency of 100 Hz derived from a time constant determined by a resistance R4 and a capacitor C5 as well as a resistance R5 and a capacitor C6. The oscillation square signal from the astable multivibrator 12 is drawn-out of a collector in transistor Q2, and is in turn connected to the base of transistor Q1 in the crystal oscillation circuit 10 via capacitor C4 and resistance R2, whereby the oscillation of the crystal oscillation circuit 10 is controlled by the astable multivibrator 12. In operation, when the transmitter switch 14 is closed for power supply, transistors Q2 and Q3 is the astable multivibrator 12 are alternately turned on and off to generate a square signal of 100 Hz in the collector in transistor Q2. Now, assume that transistor Q2 is off while transistor Q3 is on. The collector in transistor Q2 is then equal to a source voltage of about 3.0 volts, so that transistor Q1 in the crystal oscillation circuit 10 is cut off, thus turning it off. Next, when transistor Q2 is inverted from an off condition to an on condition while transistor Q3 from an on condition to an off condition, transistor Q1 in the crystal oscillation circuit 10 is caused to conduct so that it oscillates at 27.125 MHz in agreement with the resonance frequency of the crystal oscillator 20 to send the oscillation output from the antenna 18. In other words, the transmitter causes the oscillation signal of 27.125 MHz from the crystal oscillator to be amplified and modulated with the 100 Hz square signal from the astabel multivibrator 12 to send the resultant signal from the antenna 18.

This transmitter has a transmission range of 2 to 3 m indoors and a transmission power of 50 MW. To operate this transmitter at a 3-volt d.c. supply, capacitors C1 to C7 have the following values. As the antenna 18, use may be made of a flexible steel wire of 49 cm in length.

| | |
|---|---|
| R1 = 15 KΩ | C1 = 30 pF |
| R2 = 3.9 KΩ | C2 = 30 pF |
| R3 = 3.3 KΩ | C3 = 0.05 μF |
| R4 = 150 KΩ | C4 = 4.7 μF |
| R5 = 150 KΩ | C5 = 0.47 μF |
| R6 = 3.3 KΩ | C6 = 0.56 μF |
| | C7 = 100 μF |

FIG. 3 shows an integrated portion of the circuit of FIG. 2, which portion comprises transistor Q1–Q3 and resistances R1–R6 with the terminals being separately provided with capacitors C1–C7, coil L1, transmission antenna 18 and the like. Such integration of a part of the circuit ensures that the transmitter is miniaturized to considerable extent.

Figure 4:
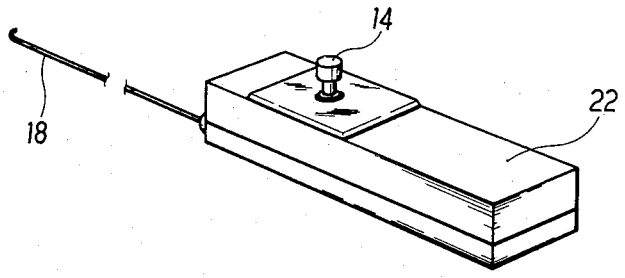
Figure 5:
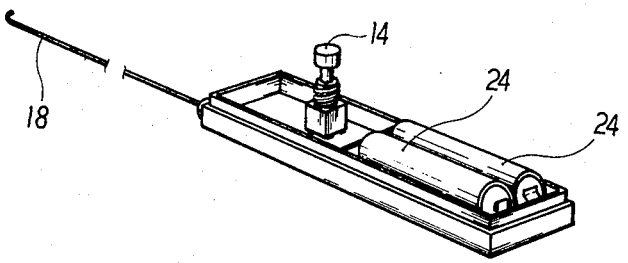

FIG. 4 is a view illustrative of the exterior of the transmitter. A panel is provided on its surface only with an operating switch 14, and a frame 22 is rigidly provided at its head portion with the antenna 18 formed of a steel wire. The frame 22 for this transmitter is 1.5 cm×2.5 cm×10 cm (thickness x width x length) in dimensions, and is of such weight that it can easily be manipulated only by an infant with one hand. Therefore, the control operation may readily be effected by pushing or pulling the operating switch 14. FIG. 5 is a view of the transmitter of FIG. 4 from which an upper lid has been removed. As will be seen from this figure, two dry cells 24 of MU-4 or AAA size are housed with the operating switch 14. The transmitter circuit shown in FIG. 2 is accommodated in an upper half of the case.

Figure 6:
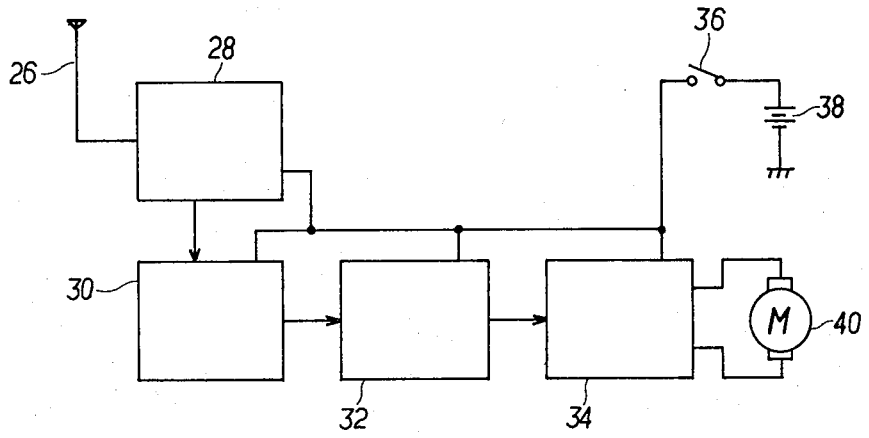

Reference will now be made to the receiver used in the present invention. Referring first to FIG. 6, there is shown a circuit block diagram of the receiver, which comprises a receiving antenna 26, a receiving circuit 28, an audio amplifier 30, a d.c. amplifier 32 and a switch circuit 34. A 3-volt d.c. supply is fed into each circuit portion by way of a d.c. power source 38 to permit forward or reverse turning of a d.c. motor 40. The receiving circuit 28 adopts a regeneration system which is adapted to further intensify the regenerative action in regenerative detection to cause oscillation, thereby to periodically repeat the oscillation and regeneration states, and has an extremely high reception sensitivity. The audio amplifier 30 is an a.c. amplifier having an amplification band ranging from 50 to 200 Hz, and the square signal output of the audio amplifier 30 is converted into a predetermined level of a continuous signal through the d.c. amplifier 32 including an integrated circuit. The switch circuit 34 is excited such that when the power supply is put to work by means of a switch 36, the d.c. motor 40 turns forward. Upon receipt of an incoming signal, this switch circuit is excited to permit reverse turning of the motor.

Figure 7:
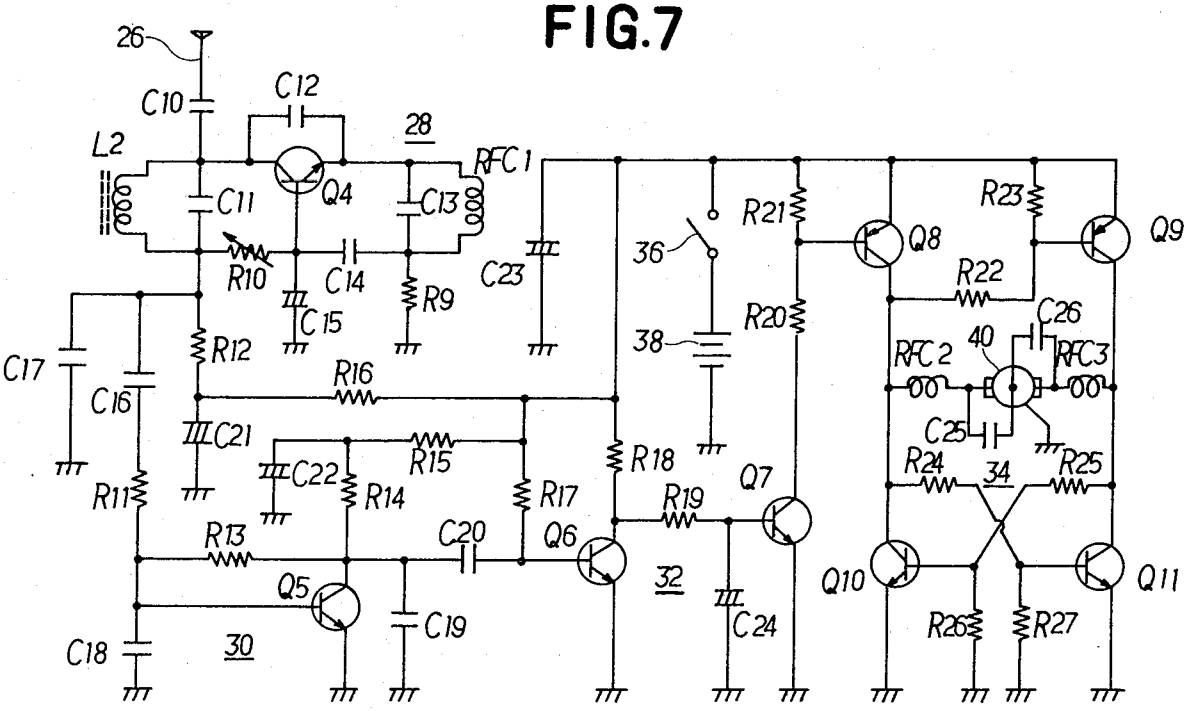

FIG. 7 is a view of the concrete construction of the receiver shown in FIG. 6. Referring first to the receiving circuit 28, it is a regenerative receiving circuit using a transistor Q4 biased by a resistance R10. The signal received on an antenna 26 is drawn out across a tuning coil L2 adjusted to 27 MHz. The regenerative detection and oscillation are repeated at certain periods by interaction of transistor Q4 and high-frequency coil RFC1 to feed the detection signal via a capacitor C16 and a resistance R11 into the audio amplifier 30. The audio amplifier 30 is two-step a.c. amplifier circuit for transistors Q5 and Q6, which is designed for use at an amplification frequency zone of 50 to 200 Hz. For instance, if a signal of 10 mVp-p is detected by the receiving circuit 28, then the radio amplifier 30 amplifies it and produces a square signal of 3 Vp-p which is limited by the source voltage. The audio amplifier 30 also serves as an active filter for drawing a 100 KHz square signal received and regenerated. In addition, the transistor Q6 serves as a rectifier to cut off the negative component of the square signal. The square signal output of the audio amplifier 30 is connected to the d.c. amplifier 32 comprising a transistor Q7 connected by way of an integrated circuit composed of a resistance R19 and a capacitor C24. This d.c. amplifier 32 acts as a drive circuit for switching a flip-flop composed of transistors Q10 and Q11 to permit forward and reverse switching of the d.c. motor 40. In other words, capacitor 24 is charged through resistance 19 so that transistor Q7 is always turned on to keep a transistor Q8 in conduction. A forward-to-reverse switching control 34 for the d.c. motor comprises transistors Q10 and Q11 forming the flip-flop and transistors Q8 and Q9 for inverting the flip-flop state.

Where no signal is received, transistor Q7 is held off to turn off transistor Q8 while transistor Q9 is held on to apply bias to transistor Q10 through resistances R25 and R26 so that the latter is held on. This causes that current flows from transistor Q9 to Q10 through the d.c. motor 40 to continue forward rotation thereof. Next, when a signal is received, a hold voltage is produced by charging of capacitor 24 due to the square signal to cause transistor Q7 to be always held on, so that transistor Q8 is also turned on,. This causes that the base bias of transistor Q9 is equal to about zero and transistor Q9 is held off. As a result, transistor Q8 is caused to conduct so that bias is applied to transistor Q1 through resistances R24 and R27 to keep Q11 in conduction. This ensures that current flows from transistor Q8 to Q11 through the d.c. motor 40, thus permitting reverse rotation of the motor so long as the signals are received.

The circuit portion and the d.c. motor in the receiver illustrated in FIG. 7 are actuated by the 3-volt d.c.

source 38. For this purpose, the resistances, capacitors and coil have the following values.

Resistance:

| | |
|---|---|
| R10 = 75 KΩ | R11 = 2.2 KΩ |
| R12 = 4.7 KΩ | R13 = 180 KΩ |
| R14 = 2.2 KΩ | R15 = 1 KΩ |
| R16 = 3.3 KΩ | R17 = 330 KΩ |
| R18 = 2.2 KΩ | R19 = 3.3 KΩ |
| R20 = 200 Ω | R21 = 430 Ω |
| R22 = 200 Ω | R23 = 430 Ω |
| R24 = 200 Ω | R25 = 200 Ω |
| R26 = 430 Ω | R27 = 430 Ω |
| R9 = 1.8 KΩ | |

Capacitor:

| | |
|---|---|
| C10 = 10 pF | C11 = 25 pF |
| C12 = 50 pF | C13 = 15 pF |
| C14 = 0.001 μF | C15 = 4.7 μF |
| C16 = 0.1 μF | C17 = 0.05 μF |
| C18 = 0.05 μF | C19 = 0.05 μF |
| C20 = 1 μF | C21 = 100 μF |
| C22 = 100 μF | C23 = 1000 μF |
| C24 = 47 μF | C25 = 0.1 μF |
| C26 = 0.1 μF | |

Tuning Coil L2: Core having 9 turns of 0.25 mmϕ enameled wire in the form of a 5 mm short wave coil with the inductance being 1.0 μH and Q=0.20 (1 KHz)

High-Frequency Coil:

RFC 1: Carbon resistance rod of 1 MΩ and ½ W having 100 turns of 0.1 mmϕ enameled wire with the inductance being 1.0 μH and Q=0.20 (1 KHz)

RFC 2: Carbon resistance rod of 1 MΩ and ½ W having 30 turns of a 0.2 mmϕ enameled wire with the inductance being 20 μH, Q=0.04 (1 KHz) and the d.c. resistance being 0.19Ω.

Figure 8:
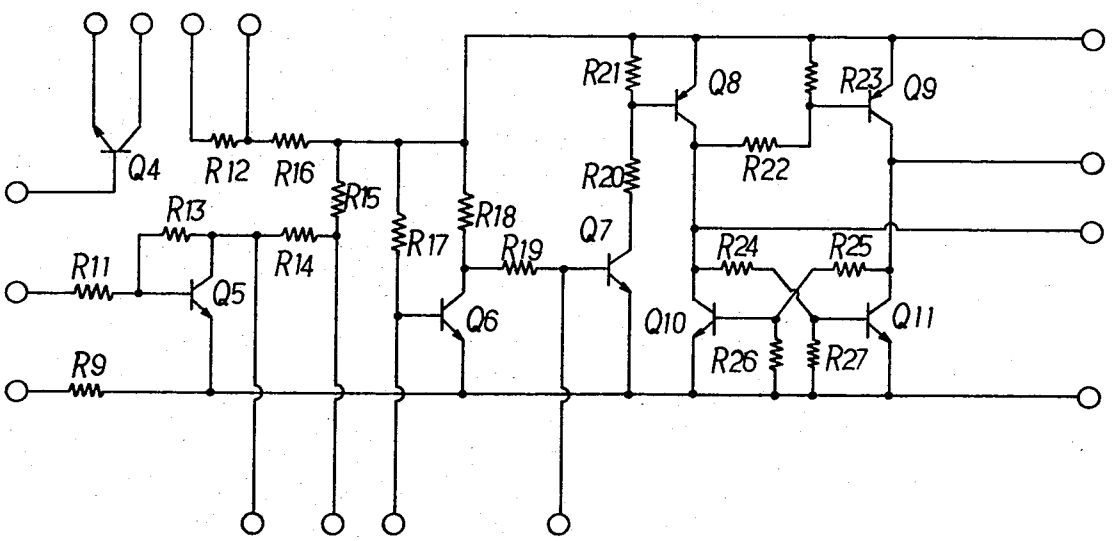

FIG. 8 is illustrative of the integrated circuit construction of the circuit portion of the receiver of FIG. 7 comprising resistances and transistors. Capacitors C10–C26, Coil L2, RFC1–3 and d.c. motor 40 are separately provided. For this reason, it is not only possible to miniaturize the receiver but it is also easy to assemble the same. It will be noted that the resistance R10 in the receiving circuit 28 of FIG. 6 is omitted from FIG. 8 since it is a variable resistance for changing the bias of transistor Q4 to adjust the sensitivity thereof.

FIG. 9 is side view of the toy car having thereon the receiver of FIG. 7. In this toy car, rear wheels 42 acting as driving wheels are rotatively supported on a chassis 50 and a front wheel 46 is rotatively supported on the center thereof, provided that front wheels shown at 44 are mounted merely for ornamental purposes. A knob 52 for a power switch in the receiver circuit is provided on the rear portion of a cover 48 in projecting fashion, and receiving antenna 26 is mounted on the upper surface of the cover 48. By way of example, this receiving antenna is formed of a steel wire of 18 cm in length.

FIG. 10 is illustrative of the toy car from which the cover has been removed. Two dry cells 58 of MU-4 or AAA size are housed in the central portion on both sides of chasses 50, and a power switch 50 having a knob 52 is provided at the position of rear wheels 52. This toy car is designed as a toy of very small size, i.e., 4.5 cm×9.5 cm×3 cm (width × length × weight).

Figure 11:
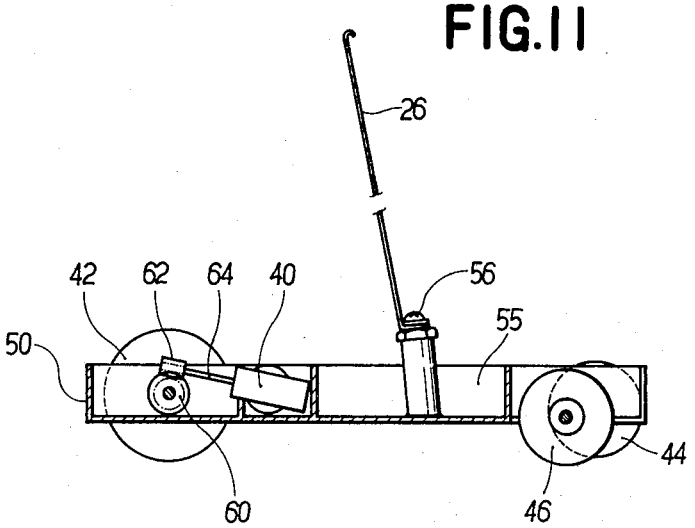

FIG. 11 is a longitudinal section view of the toy car adapted to be driven by causing a worm 62 of the output shaft 64 of the d.c. motor 40 to be in mesh engagement with a worm wheel 60 fixed to the rear wheels. The receiver circuit shown in FIG. 6 is accommodated in a cavity 55 in chassis 50 to which the receiving antenna 26 is attached by means of a screw 56. This cavity 55 has small but enough room for accommodation of the receiver shown in FIG. 6.

Figure 12:
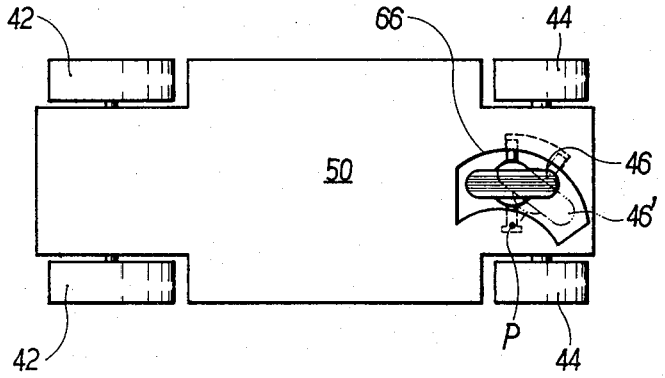
Figure 13:
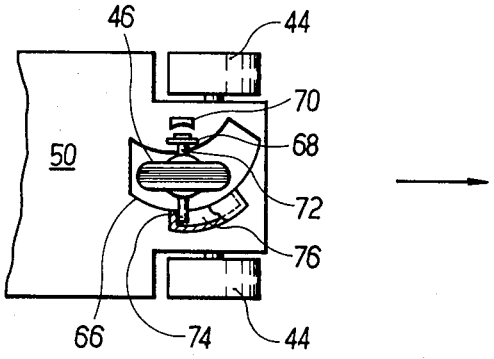
Figure 14:
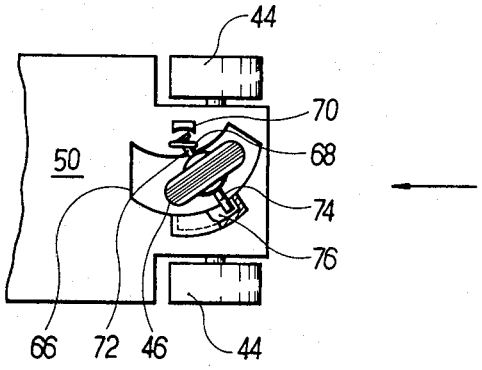

FIG. 12 shows the rear surface of the toy car, from which how to mount the front wheel 46 will more clearly by understood. The front wheel 46 is provided in a bent groove 66 such that it can pivot on one end P of its shaft to, for instance, the position shown at 46'. FIG. 13 is a plan view of the steering mechanism for the front wheel 46. One shaft 72 passes through a ring member 6 fixedly mounted on chassis 50, and is received at it one end by an abutting member 70. The other shaft 74 is slidably fitted in a guide member 76 which is opened inwardly along the bent groove 66. Accordingly, when the toy car moves forward in the direction of the arrow, the front wheel 46 finds it location at the position illustrated so that the car goes straight ahead.

Next, when the toy car is subjected to backward movement, the front wheel 46 turns around the end of the shaft 72 passing through the ring member 68 and reaches the position illustrated. Thus, the toy car turns and moves backward. The toy car can be steered in the desired direction by a combination of the steering mechanism for the front wheel and the radio-controlled forward-to-reverse switching mechanism for the d.c. motor acting as a driving source. Since the reduction ratio of the driving wheel relative to the number of rotations of the motor is relatively large, the toy car moves at relatively low speed but with torque sufficient to cause it to move on a carpet etc.

It will be understood that the radio-controlled device according to the present invention is applicable not only to a toy car but also to various radio-controlled toys by taking advantage of the features that it is possible to apply a small power source and to use the transmitter and receiver of small size.

As will be seen from the foregoing, the radio-controlled toy of the present invention can be miniaturized and manufactured at low cost by realizing the circuit construction for the transmitter operable at a 3-volt d.c. power supply induced from only two dry cells and the receiver including the d.c. motor. In particular, the radio-controlled toy according to the present invention is very easy to handle since the control operation can be carried out by a dingle control instruction provided from the transmitter and use can be made of the mechanical steering mechanism of the toy itself. Since the radio-controlled toy of the present invention is designed to have a transmission range of about 2 to 3 m for use indoors, no jamming is caused to other electrical equipment. Thus, the present invention has realized the radio-controlled toys for infants which are of great practical value.

While the invention has been described in detail and with reference to specific embodiments thereof, it will be apparent to one skilled in the art that various changes and modifications can be made therein without departing from the spirit and scope thereof.

What is claimed is:

1. A radio-controlled toy comprising a transmitter which has a transmission power affording an effective transmission range of at least 2 to 3 m and which is designed to transmit a signal amplified and modulated with a low-frequency square signal by the supply of power effected by closing a switch, a d.c. motor, a receiver, and a d.c. power source, said receiver having a receiving circuit portion adopting a regenerative system and a forward-to-reverse switching control, said d.c. motor turning forward when no signal is received by said receiver and said d.c. motor turning in reverse when a signal is received by said receiver, said switching control comprising a pair of PNP transistors in a common-emitter configuration and a pair of NPN transistors in a common-emitter configuration, the collectors of the first and second of said PNP transistors being connected, respectively, to the collectors of the first and second of said pair of NPN transistors, whereby when no signal is received by said receiver, said first PNP transistor is turned off while said second PNP transistor is held on to apply bias to said first NPN transistor to hold the same on, thereby causing current to flow from said second PNP transistor to said first NPN transistor through said d.c. motor to continue forward rotation thereof, and when a signal is received by said receiver, said first PNP transistor is turned on causing the base bias of said second PNP transistor to equal about zero, turning the same off and applying bias to said second NPN transistor, thereby causing current to flow from said first PNP transistor to said second NPN transistor through said d.c. motor to cause reverse rotation thereof.

* * * * *